United States Patent [19]

Kaufmann

[11] Patent Number: 4,900,167

[45] Date of Patent: Feb. 13, 1990

[54] MATRIX PIN PRINTER WITH ADJUSTABLE PRINT PIN GUIDE

[75] Inventor: Clemens Kaufmann, Ulm, Fed. Rep. of Germany

[73] Assignee: Mannesmann Aktiengesellschaft, Düsseldorf, Fed. Rep. of Germany

[21] Appl. No.: 262,889

[22] Filed: Oct. 25, 1988

[30] Foreign Application Priority Data

Nov. 6, 1987 [EP] European Pat. Off. ..... 87730139.0

[51] Int. Cl.[4] ..... B41J 3/12

[52] U.S. Cl. ..... 400/124; 101/93.05

[58] Field of Search ..... 400/124; 101/93.05, 101/93.04

[56] References Cited

U.S. PATENT DOCUMENTS

| | | | |
|---|---|---|---|
| 3,882,985 | 5/1975 | Liles | 400/124 |
| 4,284,363 | 8/1981 | Choberka | 400/124 |
| 4,459,051 | 7/1984 | Kawai | 400/124 |
| 4,605,323 | 8/1986 | Blanchard | 400/124 |
| 4,640,633 | 2/1987 | Hebert | 400/124 |

FOREIGN PATENT DOCUMENTS

| | | | |
|---|---|---|---|
| 2526233A1 | 1/1976 | Fed. Rep. of Germany | 400/124 |
| 3412854A1 | 3/1985 | Fed. Rep. of Germany | 400/124 |
| 3412856A1 | 3/1985 | Fed. Rep. of Germany | 400/124 |
| 224815 | 7/1985 | Fed. Rep. of Germany | 400/124 |

*Primary Examiner*—Paul T. Sewell

*Attorney, Agent, or Firm*—Horst M. Kasper

[57] ABSTRACT

The print pin drive device group (3) and a print pin guide device group (5) with a casing (8) guiding the print pins (7) is provided with an adjustable print pin guide (2) at a matrix pin print head (1). An electric lifting magnet (9) with set screw (12) for the magnet core (13) is disposed in the regiion of the print pin guide device group (5). The magnet core (13) forms together with a pin guide carrier (15) an adjustable magnetic discontinuity air gap (14). Therefore, the pin guide carrier (15) is movable back and forth between two fixedly adjustable positions. In order to provide for a precisely operating print pin guide, which is also suitable for shorter, more bend-resistant print pins, behaving stiffer against bending, it is disclosed that the electric lifting magnet (9) is disposed with its coil center axis (16) perpendicular to the center axis (17) of the matrix pin print head (1) running perpendicular to the print direction of the print pins (7) and that the magnet core (13), movable in a guide, is connected with a parallel adjustable pin guide carrier (15).

20 Claims, 2 Drawing Sheets

MATRIX PIN PRINTER WITH ADJUSTABLE PRINT PIN GUIDE

BACKGROUND OF THE INVENTION

1. Field of the Invention

The invention relates to a matrix pin print head with adjustable print pin guide, where a print pin drive device group and a pin print guide device group, disposed toward a print counter support, are provided with a casing guiding the print pins, and where an electric lifting magnet for a magnet core is disposed in the region of the print pin guide device group, where the magnet core, together with a pin guide carrier, forms an adjustable magnetic discontinuity air gap, and where the pin guide carrier is movable back and forth between two fixedly adjustable positions.

2. Brief Description of the Background of the Invention Including Prior Art

Such matrix pin print heads with adjustable print pin guide serve to generate various stages of letter-quality printing such as, for example, the generating of near-letter-quality printing as well as letter-quality printing. In this context, after one print pass, i.e. after the running through of a print line in a second print pass or in a return pass following the first print pass, the print pin guide is readjusted by less than a pin distance of about 0.3 mm, whereby the pin distance gaps are filled by further print points/dots. The adjustment of the print pin guide therefore requires a very high degree of precision between two fixed positions of impact, where the print pins are guided in a pin guide stone, which is produced from a similar material as the bearing stones for small watches.

It is known from German patent applications Laid Open DE-OS 3,412,854, DE-OS 3,412,856, DE-OS 3,403,795, DE-OS 3,412,855, and U.S. Pat. No. 4,640,633 that in case of very long print pins, which require a very long casing guiding the print pins, an electric lifting magnet can be disposed at the inside or at the outside of this casing, which magnet runs about along the print pins and about parallel to these print pins.

In this case, the print pin guide and this pin guide stone are disposed at a relatively long lever arm which, in most cases, is tiltably supported around a hinge in the region of the print pin drive device group. The motion of the pin guide stone on an arc with the radius equal to the length of the lever arm is in fact disadvantageous, because the chord height of the arc becomes noticeable in a certain adjustment region. However, up to now, this disadvantage has been considered as permissible. As far as that is concerned, such adjustable print pin guides have worked in thousands of matrix pin print heads.

Very long print pins, however, have in the meantime shown to be disadvantageous for the following reasons. The larger mass of longer print pins interferes with the print frequency, i.e. a smaller mass allows for an increase in the print frequency. The desired shorter acceleration times can be achieved with a smaller mass. Shorter print pins mean however also a shorter casing of the print pin guide device group. However, a shorter lever arm is associated with a shorter print pin, at which lever arm the pin guide carrier is attached. The shorter lever arm means a decrease of the radius, i.e. a stronger curvature bend of the arc and a shorter radius of curvature of the arc, on which arc the pin guide stone can be moved back and forth. However, it has to be taken into consideration simultaneously that shorter print pins are stiffer than longer print pins and it is therefore more difficult to bend such print pins, which in turn means that a larger drive force has to be furnished by the print pin drive device group because of increased friction in the guide planes.

SUMMARY OF THE INVENTION

1. Purposes of the Invention

It is an object of the present invention to provide a matrix pin print head with an adjustable print pin guide, which is suitable for shorter, more bend-resistant print pins, behaving stiffer against bending.

It is another object of the present invention to provide for a precision mechanism for adjusting the print pins in a matrix pin print head during different passes of the print head.

It is yet a further object of the present invention to provide a reliable mechanism for adjusting the position of the print pins in a direction parallel to the sequence of print pins.

These and other objects and advantages of the present invention will become evident from the description which follows.

2. Brief Description of the Invention

In accordance with the present invention there is provided a matrix pin print head for disposal opposite to a print counter support and having a center axis comprising a print pin drive device group. A print pin guide device group is disposed facing a print counter support, is connected to the print pin drive device group and includes an adjustable print pin guide. Print pins are associated with a print direction, where the center axis of the print head is running in the print direction of the print pins. A casing guides the print pins. A magnet core is disposed in the area of the print pin guide device group and movable in a guide for the magnet core. A set screw is coordinated to the magnet core. An electric lifting magnet, having a coil center axis and coordinated to the set screw for the magnet core, is disposed in the area of the print pin guide device group perpendicular to the center axis of the matrix print head. A pin guide carrier is parallel-adjustable. The magnet core together with the pin guide carrier forms an adjustable magnetic discontinuity air gap within the electric lifting magnet. The pin guide carrier is movable back and forth between two fixedly adjustable positions. The magnet core is connected to the pin guide carrier.

The electric lifting magnet can include a core bushing for guiding the magnet core connected to the pin guide carrier.

A threaded nut can be disposed at an end of the core bushing located remote relative to the location of the center axis. The set screw can be provided in the threaded nut. The set screw can form with the magnet core the adjustable magnetic discontinuity air gap within the electric lifting magnet.

A bent flat spring can be disposed between the pin guide carrier and the electric lifting magnet. The electric lifting magnet can be fixed at the casing of the print pin guide device group.

The pin guide carrier can form a substantially angular device component. Said angular device component can include a first arm and a second arm. The magnet core can be attached to the first arm and the pin guide stone can be attached to the second arm.

The angular device component can be attached with the second arm to a pin guide stone. The casing of the print pin guide device component can be formed as a guide with two sides and the angular device component is supported between the sides of said guide.

A bolt can attach the print pin guide device group via a shim to a plate of the print pin drive device group.

The electric magnet can comprise only a single exciter coil. The single exciter coil can have a diameter of less than 12 millimeters.

The electric lifting magnet can include a frame of an exciter coil. A bent flat spring can rest against the frame of the exciter coil for maintaining the pin guide carrier at a relative distance to the frame, which relative distance can correspond to the width of the magnetic discontinuity air gap or, respectively, to a shifting distance of the print pin guide.

The pin guide carrier can form a substantially angular device component. This angular device component can include a first arm and a second arm. The magnet core can be attached to the first arm with a rivet connection and the pin guide stone can be attached to the second arm. The angular device component can be attached with the second arm to the pin guide stone. The casing of the print pin guide device component can be formed as a guide with two sides, wherein the angular device component can be supported between the sides of said guide for allowing the second arm to move up and down by a distance corresponding to the magnetic discontinuity air gap depending on a setting of the set screw.

The outer diameter of the electric lifting magnet can be from about 0.8 to 1.2 times the diameter of the magnet core. The distance of the pin guide stone from a center axis of the lifting magnet can be from about 2 to 4 times the diameter of the magnet core. The length of the magnet core can be from about 1 to 1.3 times the diameter of the magnet core.

A control method is disclosed for positioning pins of a matrix pin print head for disposal opposite to a print counter support. Said print head has a center axis. The control method comprises the following steps. A print pin guide device group is disposed toward a print counter support. The print pin guide device group is connected to a print pin drive device group. Said print pin guide device group includes an adjustable print pin guide and print pins associated with a print direction. The center axis of the print head is running in the print direction of the print pins. The print pins are guided in a casing. A magnet core, disposed in the area of the print pin guide device group, is guided in a guide for moving the magnet core. A set screw is set at a distance relative to the magnet core. An electric lifting magnet has a coil center axis and is coordinated to the set screw for the magnet core and is disposed in the area of the print pin guide device group perpendicular to the center axis of the matrix print head for adjusting a magnetic discontinuity air gap. The magnet core together with a parallel adjustable pin guide carrier forms an adjustable magnetic discontinuity air gap within the electric lifting magnet. The pin guide carrier is movable back and forth between two fixedly adjustable positions and the magnet core is connected to the pin guide carrier.

A position of the magnet core can be maintained with a bent flat spring disposed between the pin guide carrier and the electric lifting magnet. The electric lifting magnet can be fixed at the casing guiding the print pins of the print pin guide device group.

According to the present invention the matrix pin print head includes an electric lifting magnet, which is disposed with its coil center axis perpendicular to the center axis of the matrix pin print head running in the print direction of the print pins. The magnet core, movable in a guide, is connected with a parallel adjustable pin guide carrier. This construction eliminates initially, in case of short as well as in case of long print pins, the disadvantageous consequences of the tilting motion of the pin guide stone which still can only be moved perpendicular to the center axis of the matrix print head. Furthermore, the pin guide carrier is removed from the magnetic flux circuit of the electric lifting magnet based on the attachment of the pin guide carrier at the magnet core. This means that the magnetic flux circuit becomes shorter and a better use of the energy occurs. The removal of the pin guide carrier from the magnetic flux circuit means at the same time that the pin guide carrier does no longer have to be produced from heavy iron material, but can also be made of lighter materials which results in a decisive weight reduction for this moving part.

The guide of the movable magnet core can become particularly advantageous in this way because it can be realized in a simple fashion, where the electric lifting magnet exhibits a core bushing and where the magnet core is connected to the pin guide carrier and is guided in the core bushing.

An additional improvement of the magnetic flux situation is obtained by disposing a threaded nut at the side of the core bushing disposed remote relative to the center axis, wherein such a set screw is provided which set screw forms together with the magnet core the adjustable magnetic discontinuity air gap within the electric lifting magnet. This structure means the generation of a lesser stray flux of the electric magnet and thus a higher attractive force in the region of the air gap. Since the adjustment screw or set screw is integrated as a part guiding the magnetic flux into the magnetic flux circuit, a separate adjustment screw is eliminated as compared to conventional construction.

Advantageously, the two fixedly adjustable positions of the pin guide carrier are assured by disposing a bent flat spring between the pin guide carrier and the electric lifting magnet fixed at the casing of the print pin guide device group.

The construction of the adjustable print pin guide is still further improved by forming a substantially angular device component of the pin guide carrier, where the angular device component has attached at its first arm the magnet core and at the second arm the pin guide stone.

The emphasized parallel guiding of the pin guide carrier is formed additionally without large expenditures by supporting the angular device component with the second arm, at which the pin guide stone is attached sideways in a guide, which guide is formed by the casing of the print pin guide device group.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
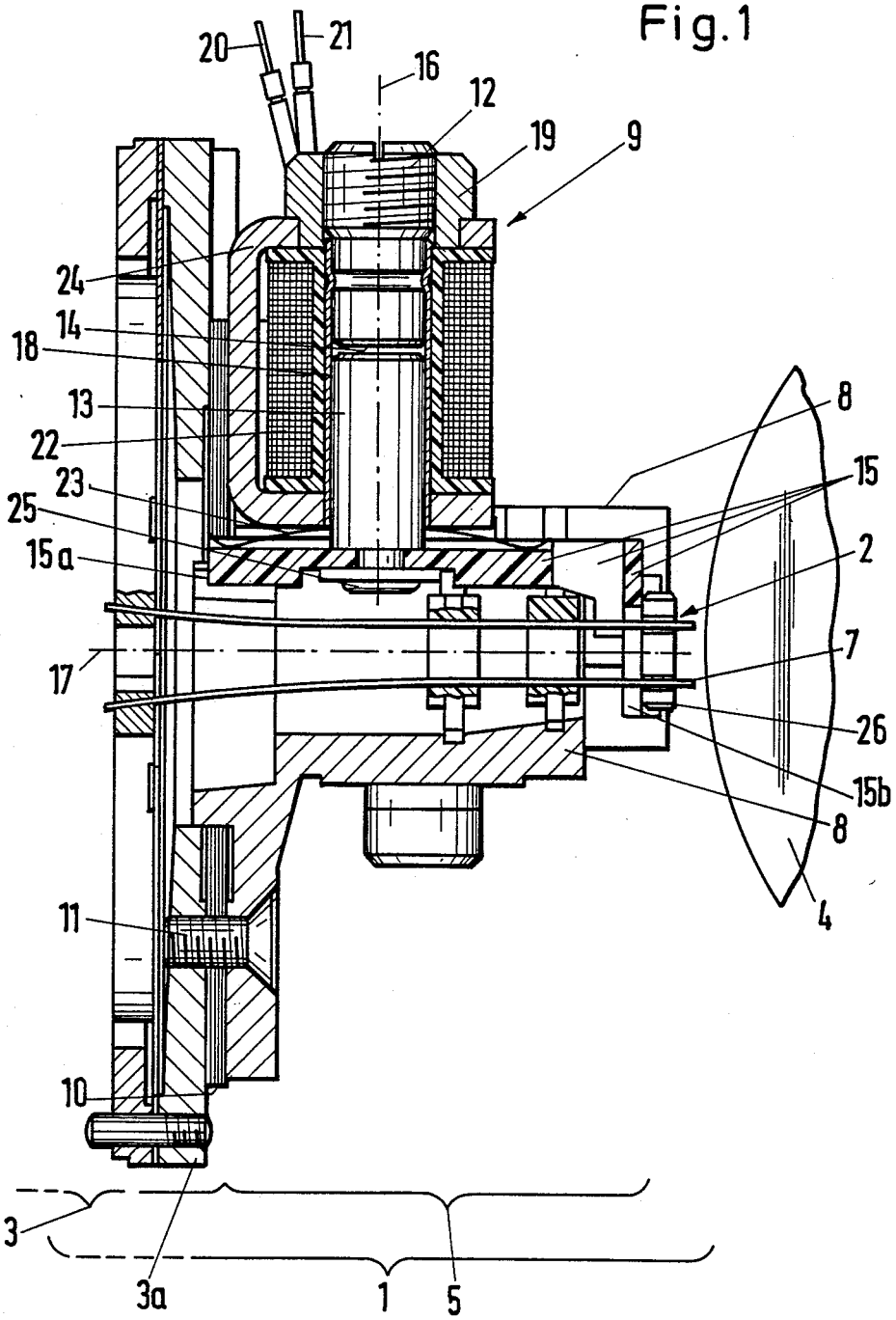
FIG. 1 is a vertical cross-sectional view through the matrix pin print head.
Figure 2:
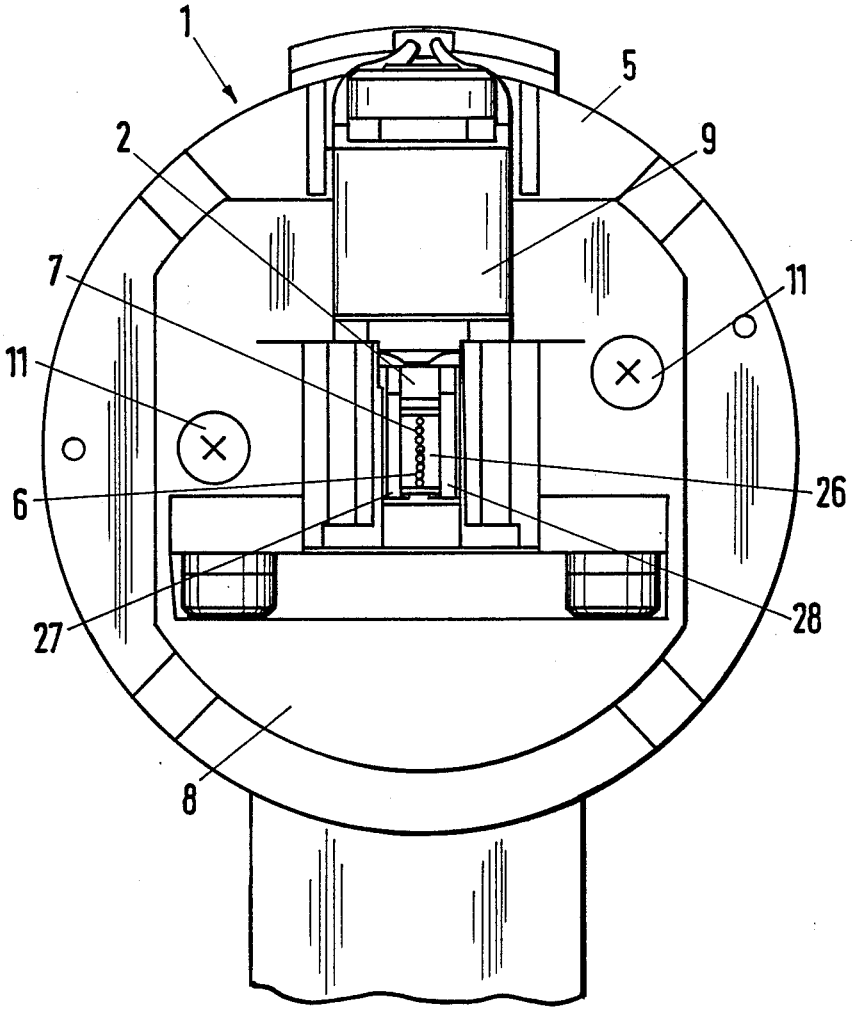
FIG. 2 is an elevational front view of the matrix pin print head according to FIG. 1.

In accordance with the present invention there is provided a matrix pin print head 1 with an adjustable print pin guide 2. A print pin drive device group 3 and a print pin guide device group 5, disposed toward a print counter support 4, are provided with a casing 8 guiding the print pins 7. An electric lifting magnet 9, with a set screw 12 for the magnet core 13, is disposed in the area of the print pin guide device group 5. Said magnet core 13, together with a pin guide carrier 15, forms an adjustable magnetic discontinuity air gap 14, whereby the pin guide carrier 15 is movable back and forth between two fixedly adjustable positions. The electric lifting magnet 9 with its coil center axis 16 is disposed perpendicular to the center axis 17 of the matrix pin print head 1. Said center axis 17 is running in the print direction of the print pins. A magnet core 13, movable in a guide, is connected to a parallel adjustable pin guide carrier 15.

The electric lifting magnet 9 can exhibit a core bushing 18. The magnet core 13, connected to the pin guide carrier 15, can be guided in the core bushing 18.

A threaded nut 19 can be disposed at the side of the core bushing 18 disposed remote relative to the side of the center axis 17. A set screw 12 can be provided in the threaded nut 19 and can form with the magnet core 13 an adjustable magnetic discontinuity air gap 14 within the electric lifting magnet 9.

A bent flat spring 23 can be disposed between the pin guide carrier 15 and the electric lifting magnet 9 fixed at the casing 8 of the print pin guide device group 5.

The pin guide carrier 15 can form a substantially angular device component. Said angular device component can have the magnet core 13 attached to its first arm **15*a* and the pin guide stone 26 attached to its second arm 15*b***.

The pin guide stone 26 can be attached to the second arm **15*b* and can be supported sideways in a guide 27, 28. Said guide 27, 28 can form the casing 8 of the print pin guide device component 5**.

In accordance with the present invention, the matrix pin print head 1 is equipped with an adjustable print pin guide 2. In its principle construction, the matrix pin print head includes a print pin drive device group 3, which is only indicated in the drawings, and a print pin guide device group 5 disposed toward a print counter support 4, where the print pin guide device group 5 includes a slot 6 formed for print pins 7. The print pins 7, which for example form a slot 6 of nine or twelve print pins 7, are guided in a casing 8. An electric lifting magnet 9 is disposed in the region of the print pin guide device group 5 for the adjustable print pin guide 2.

The print pin guide device group 5 is screwed with bolts 11, under insertion of adjustment sheet metal shims 10, onto a plate **3*a* of the print pin drive device group 3**.

The electric lifting magnet 9 includes an adjustment screw 12. The magnet core 13 is adjusted to a favorable magnetic discontinuity air gap 14 or, respectively, readjusted after assembly, with the adjustment screw 12. The print pin guide 2 is a pin guide carrier 15, which will be described in more detail below. This print pin guide 2 is moved back and forth through the electric lifting magnet 9 between two fixedly determined positions.

The electric lifting magnet 9 with its coil center axis 16 is disposed perpendicular to the center axis 17 of the matrix pin print head 1, in particular for relatively short print pins 7 of a length of, for example, 27 mm, whereby the print pins 7 print essentially in the direction of this center axis 17 or, respectively, in parallel to the center axis 17. The guided magnet core 13 adjusts the pin guide carrier 15 with the print pin guide 2 parallel in the direction of the coil center axis 16 in such a way that the print pin guide 2 is adjusted perpendicular and not arcuate relative to the center axis 17. For this purpose, the electric lifting magnet 9 is furnished with a core bushing 18, and the magnet core 13, connected to the pin guide carrier 15, is slidingly guided in the core bushing 18. A threaded nut 19 is disposed at the side remote relative to the magnet core 13 at the electric lifting magnet 9. A set screw or adjustment screw 12 is provided in the threaded nut 19 such that the set screw 12 forms together with the magnet core 13 a magnetic discontinuity air gap 14 disposed about in the center of the guide bore length of the electric lifting magnet 9. This entering and incorporation of the magnetic discontinuity air gap 14 into the core bushing 18 saves stray fluxes such that less energy requirements exist at the electric connections 20 and 21.

Simultaneously, only a single exciter coil 22 is required at a voltage of 36 volts at the electric connections 20 and 21. The exciter coil 22 results in a very short casing 8 of the print pin guide device group 5 in case of relatively short print pins 7. In other words, the exciter coil 22 exhibits an extremely small diameter of a maximum of about 12 mm.

The pin guide carrier 15 is maintained at a distance by way of a bent flat spring 23, which rests against the frame 24 for the exciter coil 22. The distance corresponds to the magnetic discontinuity air gap 14 or, respectively to the lifting distance for the print pin guide 2.

The pin guide carrier 15 forms a substantially angular component with a first arm **15*a*, at which arm 15*a* the magnet core is attached with a rivet connection 25, and a second arm 15*b*, in which second arm 15*b* the pin guide stone 26 is attached. This second arm 15*b* is supported at the casing 8 of the print pin guide device group 5 in a respectively laterally formed guide 27 or, respectively, 28. The second arm 15*b* can be moved upward and downward depending on the size distance of the magnetic discontinuity air gap 14 between the guides 27 and 28, which in turn depends on the setting of the set screw or adjustment screw 12**.

It will be understood that each of the elements described above, or two or more together, may also find a useful application in other types of matrix pin printer differing from the types described above.

While the invention has been illustrated and described as embodied in the context of a matrix pin printer with adjustable print pin guide, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A matrix pin print head for disposal opposite to a print counter support and having a center axis comprising a print pin drive device group; a print pin guide device group disposed facing a print counter support, connected to the print pin drive device group and including:

an adjustable print pin guide;

print pins associated with a print direction, where the center axis of the print head is running in the print direction of the print pins;

a casing guiding the print pins;

a guide for a magnet core;

a magnet core disposed in the area of the print pin guide device group and movable in the guide for the magnet core;

a set screw coordinated to the magnet core;

an electrical lifting magnet having a coil center axis and coordinated to the set screw for the magnet core and disposed in the area of the print pin guide device group perpendicular to the center axis of the matrix print head;

a parallel adjustable pin guide carrier, where the magnet core together with the pin guide carrier forms an adjustable magnetic discontinuity air gap within the electric lifting magnet and whereby the pin guide carrier is movable back and forth between two fixedly adjustable positions and wherein the magnet core is connected to the pin guide carrier so that the pin guide carrier and print pin guide move along a linear path between the two fixedly adjustable positions.

2. The matrix pin print head according to claim 1 wherein the electric lifting magnet includes a core bushing for guiding the magnet core connected to the pin guide carrier.

3. The matrix pin print head according to claim 1 further comprising a threaded nut disposed at an end of the core bushing located remote relative to the location of the center axis, wherein the set screw is provided in the threaded nut, where the set screw forms with the magnet core the adjustable magnetic discontinuity air gap within the electric lifting magnet.

4. The matrix pin print head according to claim 1 further comprising a bent flat spring is disposed between the pin guide carrier and the electric lifting magnet and wherein the electric lifting magnet is fixed at the casing of the print pin guide device group.

5. The matrix pin print head according to claim 1 wherein the pin guide carrier forms a substantially angular device component, which angular device component includes a first arm and a second arm and wherein the magnet core is attached to the first arm and the pin guide stone is attached to the second arm.

6. The matrix pin print head according to claim 5 further comprising a guide pin stone, wherein the angular device component is attached with the second arm to the pin guide stone;

wherein the casing of the print pin guide device component is formed as a guide with two sides and wherein the angular device component is supported between the sides of said guide.

7. The matrix pin print head according to claim 1 further comprising a shim;

a bolt attaching the print pin guide device group via the shim to a plate of the print pin drive device group.

8. The matrix pin print head according to claim 1 wherein the electric magnet comprises only a single exciting coil.

9. The matrix pin print head according to claim 8 wherein the single exciting coil has a diameter of less than 12 millimeters.

10. The matrix pin print head according to claim 1 wherein the electric lifting magnet includes a frame of an exciting coil; and further comprising a bent flat spring resting against the frame of the exciting coil for maintaining the pin guide carrier at a relative distance to the frame, which relative distance corresponds to the width of the magnetic discontinuity air gap or, respectively, to a shifting distance of the print pin guide.

11. The matrix pin print head according to claim 1 wherein the pin guide carrier forms a substantially angular device component, which angular device component includes a first arm and a second arm and wherein the magnet core is attached to the first arm with a rivet connection and wherein the pin guide stone is attached to the second arm;

a guide pin stone, wherein the angular device component is attached with the second arm to the pin guide stone;

wherein the casing of the print pin guide device component is formed as a guide with two sides and wherein the angular device component is supported between the sides of said guide for allowing the second arm to move up and down by a distance corresponding to the magnetic discontinuity air gap depending on a setting of the set screw.

12. The matrix pin print head according to claim 1 wherein the outer diameter of the electric lifting magnet is from about 0.8 to 1.2 times the diameter of the magnet core;

wherein the distance of the pin guide stone from a center axis of the lifting magnet is from about 2 to 4 times the diameter of the magnet core;

wherein the length of the magnet core is from about 1 to 1.3 times the diameter of the magnet core.

13. A matrix pin print head (1) with adjustable print pin guide (2), where a print pin drive device group (3) and a print pin guide device group (5), disposed toward a print counter support (4), are provided with a casing (8) guiding the print pins (7), and wherein an electric lifting magnet (9) with a set screw (12) for the magnet core (13) is disposed in the area of the print pin guide device group (5), which magnet core together with a pin guide carrier (15) forms an adjustable magnetic discontinuity air gap (14) and whereby the pin guide carrier (15) is movable back and forth between two fixedly adjustable positions;

wherein the electric lifting magnet (9) with its coil center axis (16) is disposed perpendicular to the center axis (17) of the matrix pin print head 1, which center axis (17) is running in the print direction of the print pins, and wherein a magnet core (13) movable in a guide is connected to a parallel adjustable pin guide carrier (15) so that the pin guide carrier and print pin guide move along a linear path between the two fixedly adjustable positions.

14. The matrix pin print head (1) according to claim 13 wherein the electric lifting magnet (9) exhibits a core bushing (18), wherein the magnet core (13) connected to the pin guide carrier (15) is guided in the core bushing (18).

15. The matrix pin print head (1) according to claim 13 wherein a threaded nut (19) is disposed at the side of the core bushing (18) disposed remote relative to the side of the center axis (17), wherein a set screw (12) is provided in the threaded nut (19) and where the set screw (12) forms with the magnet core (13) an adjustable magnetic discontinuity air gap (14) within the electric lifting magnet (9).

16. The matrix pin print head (1) according to claim 13 wherein a bent flat spring (23) is disposed between the pin guide carrier (15) and the electric lifting magnet (9) fixed at the casing (8) of the print pin guide device group (5).

17. The matrix pin print head (1) according to claim 13 wherein the pin guide carrier (15) forms a substantially angular device component, which angular device component has the magnet core (13) attached to its first arm (15*a*) and the pin guide stone (26) attached to its second arm (15*b*).

18. The matrix pin print head (1) according to claim 17, where the pin guide stone (26) is attached to the second arm (15*b*), is supported sideways in a guide (27, 28), which guide (27, 28) forms the casing (8) of the print pin guide device component (5).

19. A control method for positioning pins of a matrix pin print head for disposal opposite to a print counter support and said print head having a center axis comprising the steps:

disposing a print pin guide device group toward a print counter support;

connecting the print pin guide device group to a print pin drive device group where the print pin guide device group includes an adjustable print pin guide 2, print pins associated with a print direction, where the center axis of the print head is running in the print direction of the print pins;

guiding the print pins in a casing;

guiding a magnet core disposed in the area of the print pin guide device group in a guide for moving the magnet core;

setting a set screw at a distance relative to the magnet core, where an electric lifting magnet has a coil center axis and is coordinated to the set screw for the magnet core and is disposed in the area of the print pin guide device group perpendicular to the center axis of the matrix print head for adjusting a magnetic discontinuity air gap, wherein the magnet core together with a parallel adjustable pin guide carrier forms an adjustable magnetic discontinuity air gap within the electric lifting magnet and whereby the pin guide carrier is movable back and forth between two fixedly adjustable positions and wherein the magnet core is connected to the pin guide carrier so that the pin guide carrier and print pin guide move along a linear path between the two fixedly adjustable positions.

20. The control method for positioning pins of a matrix pin print head according to claim 19 further comprising maintaining a position of the magnet core with a bent flat spring disposed between the pin guide carrier and the electric lifting magnet and wherein the electric lifting magnet is fixed at the casing guiding the print pins of the print pin guide device group.

* * * * *